United States Patent [19]

Reitman

[11] 4,034,840

[45] July 12, 1977

[54] LOCK MECHANISM

[75] Inventor: Morton L. Reitman, Pepper Pike, Ohio

[73] Assignee: Hospital Specialty Company, Solon, Ohio

[21] Appl. No.: 686,792

[22] Filed: May 17, 1976

[51] Int. Cl.[2] ..... G07F 5/04
[52] U.S. Cl. ..... 194/65; 194/1 G
[58] Field of Search ..... 194/61, 63, 64, 65, 194/69, 70, 1 G, DIG. 2

[56] References Cited

U.S. PATENT DOCUMENTS

| | | | |
|---|---|---|---|
| 1,862,372 | 6/1932 | Richardson | 194/DIG. 2 |
| 1,874,497 | 8/1932 | Gildemeister | 194/70 |
| 2,321,199 | 6/1943 | Grunig | 194/61 |
| 3,376,966 | 4/1968 | Pennell | 194/63 |

*Primary Examiner*—Stanley H. Tollberg
*Attorney, Agent, or Firm*—Woodling, Krost, Granger & Rust

[57] ABSTRACT

A lock mechanism operated by a multiple of coins in which the coins are carried by a rotatable member in such manner that the coins cooperate with each other to maintain the proper position of at least one of the coins for operating the lock mechanism.

6 Claims, 11 Drawing Figures

LOCK MECHANISM

My invention relates to a lock mechanism operable with the use of coins. In the specification and claims the term "coins" is to be taken as including monetary coins, tokens and slugs sized and shaped to function as monetary coins in the operation of the lock mechanism.

An object of my invention is to provide for the operation of the lock mechanism by at least two coins of a plurality of such coins, rather than by one coin.

Another object is to assure efficient operation of a lock mechanism by the use of a multiple of coins, such as two coins.

Another object is the provision in a lock mechanism for properly holding a plurality of coins in a manner that the coins cooperate with each other to assure efficient operation of the lock mechanism with the use of a multiple of coins.

Another object is the provision in a coin operative lock mechanism of means to hold two coins in face-to-face abutting relationship to assure that one of the coins is positioned and maintained to properly operate the lock mechanism.

Another object is the provision in a coin operative lock mechanism of means to hold two coins in edge-to-edge abutting relationship to assure that one of said coins is positioned and maintained to properly operate the lock mechanism.

My improved lock mechanism is of the general class of coin operated lock mechanisms of U.S. Pats. No. 1,874,497 issued to Gildemeister and No. 2,117,302 issued to Darman.

Other objects and a fuller understanding of my invention may be had by referring to the following description and claims, taken in conjunction with the accompanying drawings in which:

(In FIGS. 1, 2, 3 and 4, the internal parts of the mechanism are shown in broken lines and illustrate four successive positions of the internal parts as the mechanism is operated with the use of coins from the initial position of inserting coins to the ultimate position of depositing the coins, during which sequence of events a bolt or lever of a mechanism within the cabinet is actuated).

Figure 5:
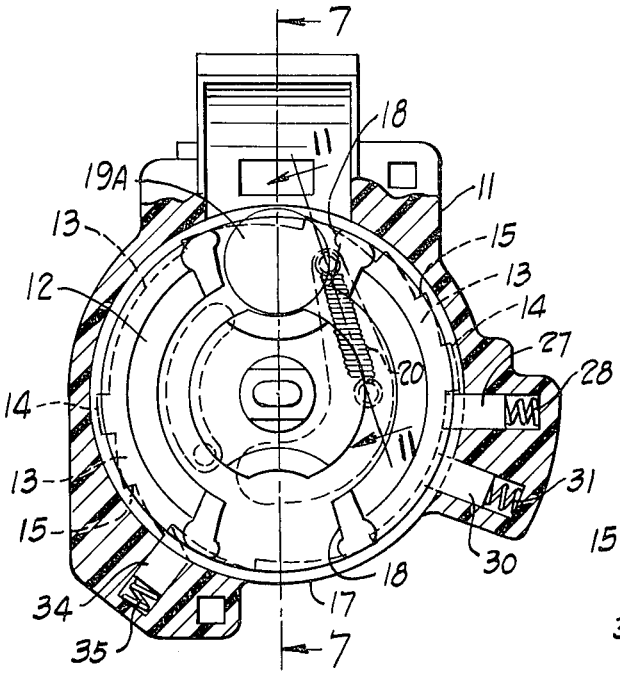
Figure 6:
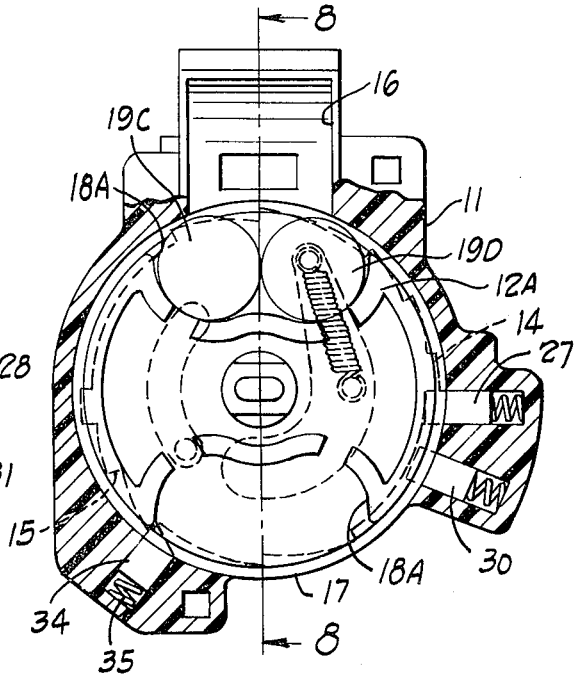

FIG. 5 is cross-sectional view of my lock mechanism and is taken through the line 5—5 of FIG. 6;

FIGS. 1 to 5, inclusive, illustrate a first and preferred form of my invention constructed and adapted to utilize two similar coins, such as two quarters, disposed in abutting face-to-face relationship to each other, the coins appearing in axial alignment with each other in FIGS. 1 to 5 inclusive.

Figure 1:
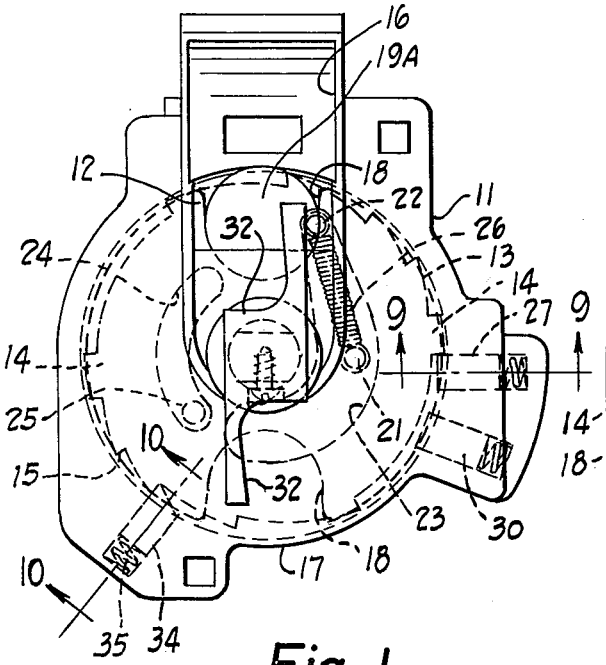
FIG. 1 is a front view of my improved lock mechanism as it would be mounted on a cabinet or the like for the acutation of a bolt or lever within the cabinet which locks or unlocks the mechanism, such as merchandise dispensing mechanism, within the cabinet.
Figure 2:
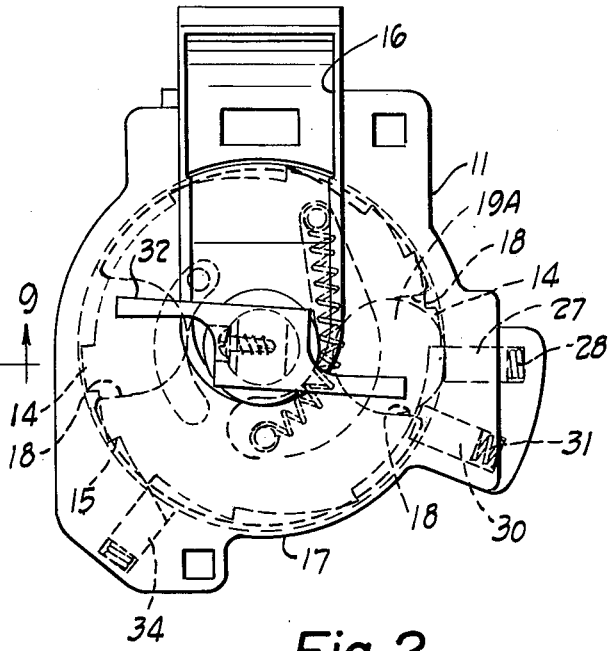
FIG. 2 is a front view somewhat similar to that of FIG. 1 but showing the internal parts in a different operating position.
Figure 7:
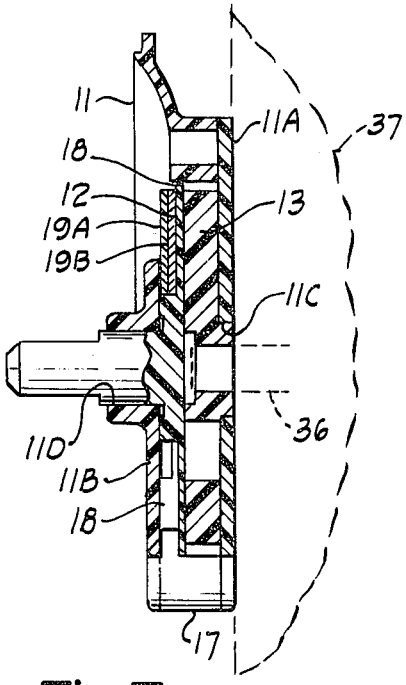
Figure 8:
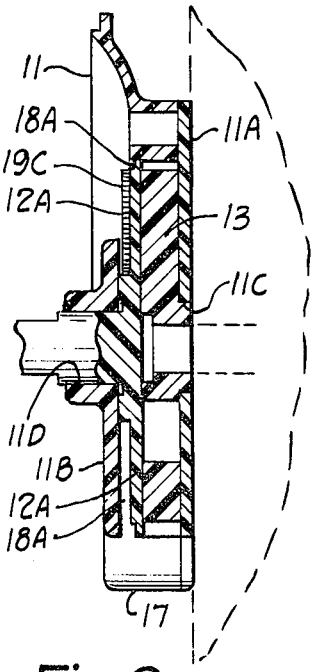
Figure 9:
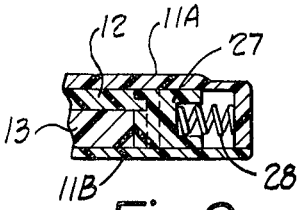
Figure 10:
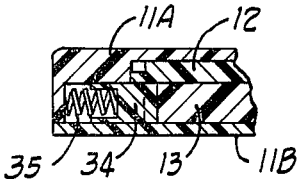

FIG. 6 is a cross-sectional view of a modified form of my lock mechanism somewhat like that of FIG. 5 but constructed and adapted to utilize two similar coins, such as two quarters, arranged in edge-to-edge relationship to each other and in the same plane;

FIG. 7 is a sectional view taken through the line 7—7 of FIG. 5;

FIG. 8 is a sectional view taken through the line 8—8 of Fig. 6;

FIG. 9 is a sectional view taken through the line 9—9 of FIG. 1;

FIG. 10 is a sectional view taken through the line 10—10 of FIG. 1; and

Figure 11:
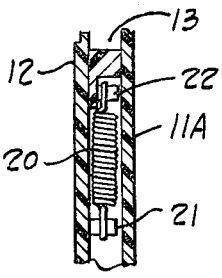

FIG. 11 is a sectional view taken through the line 11—11 of FIG. 5.

The first form of my mechanism has a casing or housing 11 which is adapted to be mounted on the front of a cabinet, such as a merchandise dispensing cabinet, indicated by the reference character 37 in FIG. 7. The casing 11 has a rear wall 11A and a front wall 11B, which walls are joined around the periphery thereof to form a hollow enclosure. Extending axially through the walls 11A and 11B is a rear axial opening 11C and a front axial opening 11D. Mounted within the casing 11 are two disk members 12 and 13. The first disk member 12 is mounted toward the front of the casing and the second disk member 13 is mounted next adjacent the first disk member and in axial alignment therewith. The axes of the disk members 12 and 13 are in axial alignment with the openings 11C and 11D of the casing.

Extending forwardly through the front axial opening 11D of the casing there is the shaft of a handle 32, the handle 32 being accessible for manual turning from the front or face of the casing. The second disk member 13 engages at its rearward face through the rear opening 11C a bolt or lever 36 which is actuated upon turning or rotation of the second disk member 13 in the operation to be described. This bolt or lever 36 is, in turn, connected to either the bolt which locks or unlocks the door of the cabinet or to a dispensing mechanism within the cabinet, which dispensing mechanism dispenses merchandise from an opening or well in the cabinet in the usual manner.

The second disk member 13 has two projections 14 extending radially outward from its circumferential boundary on diametrically opposite sides of the disk member. The disk member 13 also has a plurality of detent teeth 15 projecting radially outward therefrom at spaced intervals therearound, as indicated in the drawings. As seen, the detent teeth 15 have a blunt or abrupt side and a slanted or inclined side so adapted in the usual manner to permit rotation in only one direction in cooperation with a spring-biased detent plunger 34 carried by the casing 11. The detent plunger 34 is urged radially inward by a coil spring 35, both the detent plunger 34 and the coil spring 35 being mounted in a suitable recess 33 in the inner wall of the casing as shown in the drawing. The inner end face of the detent plunger 34 is slanted as shown so that the detent plunger 34 in cooperation with the detent teeth 15 permits rotation of the second disk member 13 in only one direction, that is, in a clockwise direction as viewed in FIGS. 1–6, inclusive.

The casing 11 has an inlet opening 16 located at the upper portion thereof which coins, such as coins 19A and 19B, may be inserted. It is to be understood that the coins 19A and 19B may be legal tender, or tokens or slugs. At the bottom of the casing 11 there is an outlet opening 17 through which the coins may drop and be deposited in a box below the mechanism within the cabinet.

The first disk member 12 is round and does not have the projections and detent teeth as on the second disk member 13. On diametrically opposite sides of the first disk member 12, there are arcuate recesses 18 formed therein to accommodate the major portion of coins 19A and 19B, but which hold the coins so as to protrude radially outward from the periphery of the first disk member as shown. The opposite recesses 18 are so situated that while one recess 18 is uppermost for reception of a coin, the other recess 18 is lowermost for the ejecting of discharge of a coin to the coin box below. Thus, there are two operating cycles, the mechanism being operated by successive sets of coins 19A and 19B in the two diametrically opposed recesses 18.

The coins 19A and 19B are in face-to-face abutting relationship to each other, as better seen in FIG. 7. In FIGS. 1–5, inclusive, the outlines of coins 19A and 19B coincide.

Formed in the second disk member 13 there is a first arcuate cavity 23 as shown, in which cavity 23 there is accommodated a coil spring 20. This spring 20 has one end carried by the first disk member 12 by means of a boss 21 projecting from the disk member 12 into the cavity 23, as better seen in FIG. 11. The other end of the spring 20 is anchored to the second disk member 13 by means of a boss 22 carried by the second disk member 13, as better seen in FIG. 7. The bias of the spring 20 is such that when the first disk member is rotated by manually turning the handle 32, the second disk member is resiliently urged to yieldably biased to follow the rotative movement of the first disk member. As seen in the drawings, the second disk member 13 tends to move with the first disk member 12 in its rotative movement except for means to be described. To provide a limit in relative movements between the disk members, a second and smaller arcuate cavity 24 may be provided in the second disk member 13 and a limit pin 25 carried by the first disk member 12 protrudes into the cavity 24.

On one side of the casing 11 there are two plunger members 27 and 30 circumferentially spaced apart but relatively close together in the manner illustrated. The first plunger member 27 is slidably movable in a recess 26 radially inwardly and outwardly relative to the disk members. A coil spring 28 resiliently urges the first plunger member 27 radially inward toward the axes of the disk members and in engagement with the periphery of both disk members. The second plunger member 30 is similarly carried in a recess 29 in the casing 11 and is in like manner spring-biased toward the axes of the disk members by a coil spring 31, the inner face of the second plunger member 30 being similarly urged into engagement with the periphery of both disk members.

It will be noted that the plunger members, such as plunger 27 shown in FIG. 9, have their inner faces so as to engage and slidably ride along the periphery of both disk members 12 and 13. However, as seen in FIG. 10, the detent plunger 34 is of a width so as to engage and slidably ride along only on the periphery of the second disk member 13. The second disk member 13 has a continuous rim or circular portion next adjacent the first disk member 12 so as to give continuous backing to inward coin 19B as it moves along with the first disk member adjacent the second disk member. The plungers 27 and 30 have cut-out portions adjacent the inner faces so as to ride over or straddle this rim or circular portion of the second disk member. The plungers thus have coin-engaging portions in a plane normal to the axis of the disk member and in the path of the inwardly disposed coin 19B.

Figure 3:
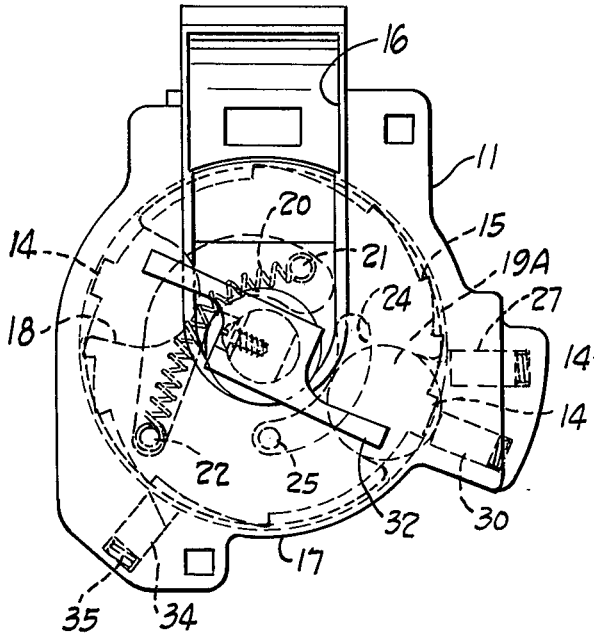
FIG. 3 is a view somewhat like that of FIGS. 1 and 2 but showing the internal parts in a subsequent operating position.
Figure 4:
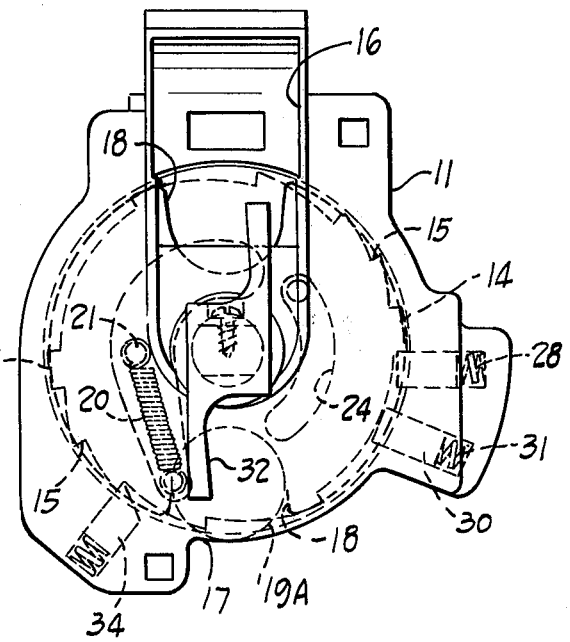
FIG. 4 is a view somewhat like that of FIGS. 1, 2 and 3 but showing the internal parts positioned in a still further subsequent operating position.

In operation, coins 19A and 19B are placed into the opening 16 of the casing 11 and downwardly into the uppermost recess 18 of the first disk member 12. The two coins are then in face-to-face abutting relationship to each other. The handle 32 is thereupon rotated in a clockwise direction by the operator, and this moves the coins 19A and 19B from the position shown in FIG. 1 to the position shown in FIG. 2. Here the coin 19B of the two coins cammingly moves the first plunger member 27 radially outward and this causes the first plunger member 27 to clear the projection 14 otherwise blocked by the first plunger member 27. Continued manual rotation of the first disk member 12 in a clockwise direction moves the parts to the position illustrated in FIG. 3. Here the coin 19B cammingly engages and moves radially outwardly the second plunger member 30 so as to cause the projection 14 to be cleared by the second plunger member 30. The inner end faces of the plungers 27 and 30 are spaced apart less than the circumferential extent of the projection 14, as seen, and the first plunger member 27 in the position shown in FIG. 3 is temporarily held radially outwardly by one of the multiplicity of detent teeth 15. The coin 19B successively moves the plunger members 27 and 30 in the sequence illustrated and thus permits the second disk member 13 to rotate under the urging of the spring 20 as the first disk member 12 is rotated. As the first disk member has moved to where the coins 19A and 19B are in the lowermost recess 18, as in FIG. 4, the second disk member 13 has rotated 180 degrees along with the first disk member and the parts are now in the position shown in FIG. 4. The detent plunger 34 permits the repeated movement of the second disk member 13 in a clockwise direction but prevents rotative movement in a reverse direction.

It is to be noted that the forwardly disposed coin 19A maintains coin 19B flat in the plane normal to the axis of the disk members and coinciding with the plane passing through the coin-engaging portion of the plungers to meet and engage the same. Tilting of coin 19B is prevented by the abutting coin 19A which would jam the mechanism and prevent operation of the lock mechanism. Thus both coins are necessary for the efficient operation of the mechanism.

It has been found that rapid action is obtained and the mechanism is operated with ease and facility. Coins or tokens or slugs only of the required size and dimensions are accommodated. A merchandise dispensing mechanism within the cabinet is readily actuated by the manual turning of the handle when a required coin or the like is inserted and moved in the described manner to radially displace outwardly in the described sequence the plunger members 27 and 30.

In the modified form illustrated in FIGS. 6 and 8, the coin receiving recess in disk member 12A is denoted by the reference character 18A. It differs from recess 18 in disk member 12 in that it is sized and shaped to receive two similar coins 19C and 19D such as two quarters in edge-to-edge relationship in the plane normal to the axes of the disk members and in the plane of the coin engaging portion of the plungers. Upon the coin 19D meeting plunger 27 the resistance tends to move the coin 19D rearwardly. However, the coin 19C in the edge-to-edge relationship to it prevents this backward movement, both coins 19C and 19D substantially filling the elongated recess 18A. Without the backing of a coin 19C the first coin 19D would roll back and up through the inlet 16 of the casing 11. Thus, in the modified form of my invention in which there is a relatively shallow and elongated recess 18A, it requires both coins 19C and 19D to operate the lock mechanism.

The present disclosure includes that contained in the appended claims, as well as that of the foregoing description.

Although this invention has been described in its preferred form with a certain degree of particularity, if is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. In a lock mechanism having a hollow casing having a transverse opening extending therethrough along the axis thereof from a first side to a second side of the casing, said casing having an inlet opening and an outlet opening extending through the wall thereof an diametrically opposite sides of said transverse opening, a first disk member mounted in said casing to rotate on the said axis of the casing, said first disk member having a handle portion extending through the said tranverse of said casing to said first side thereof for the manual rotation of the first disk member from said first side, said first disk member having a recess in its periphery to receive an operative coin to protrude radially from the periphery of the first disk member and adapted to register with said inlet opening for insertion of said coin thereon and to register with said outlet opening for discharge of a said coin or the like therefrom, a second disk member mounted in said casing adjacent said first disk member to rotate in said casing on a common axis with said first disk member, said second disk member having an engaging portion extending through the said transverse opening of the casing to said second side thereof for engagement with lock operating means to be controlled by said lock mechanism, biasing means joining said first and second disk members for biasing the second disk member to rotatably follow the rotation of said first disk member upon manual rotation by said handle portion, said second disk member having a projection extending radially outward therefrom, plunger means carried by said casing and resiliently urged radially inward toward the said common axis at a first location around the casing spaced from said inlet opening, said plunger means having a coin-engaging portion disposed in a first plane normal to the axis of said first disk member, said plunger means being positioned to be displaceable radially outwardly by a coin carried in the recess of the first disk member upon rotation thereof, said plunger means being located when the positioned radially inward to engage the said projection of the second disk member for blocking rotation thereof and when displaced radially outwardly to clear said projection of said second disk member and for permitting rotation thereof, said detent means carried by the casing and engaging the second disk member to permit rotation of the second disk member in one direction only relative to said casing, the improvement of said recess in the first disk member being dimensioned and shaped to receive more than one said coin so as to position at least one of the coins flat in said first plane normal to the axis of the first disk member and in the path of said coin-engaging portion of the said plunger means, said one coin being maintained in said position by other of said coins during rotation of the first disk member to engage and move said plunger means to displace the same radially outward to clear the said projection and thereby permit the said disk members to rotate beyond said plunger means.

2. The improvement claimed in claim 1 and in which said recess is dimensioned and shaped to accommodate said coins in parallel planes and in face-to-face abutment whereby said one coin is maintained flat in said first plane by the abutting coin to assure engagement of said coin engaging portion of said plunger means to move radially outward the said plunger means.

3. The improvement claimed in claim 1 and in which said recess is dimensioned and shaped to accommodate said coin arranged edge-to-edge in said first plane whereby the coin first engaging said plunger means is backed up and prevented from rolling in reverse by the other one or more coins in said recess upon the coin first engaging the plunger means to move radially outward the said plunger means.

4. In a lock mechanism having a hollow casing having a transverse opening extending therethrough along the axis thereof from a first side to a second side of the casing, and casing having an inlet opening and an outlet opening extending through the wall thereof on diametrically opposite sides of said tranverse opening, a first disk member mounted in said casing to rotate on the said axis of the casing, said first disk member having a handle portion extending through the said transverse of said casing to said first side thereof for the manual rotation of the first disk member from said first side, said first disk member having a recess in its periphery to receive the operative coin to protrude radially from the periphery of the first disk member and adapted to register with said inlet opening for insertion of said coin thereon and to register with said outlet opening for discharge of a said coin or the like therefrom, a second disk member mounted in said casing adjacent said first disk member to rotate in said casing on a commmon axis with said first disk member, said second disk member having an engaging portion extending through the said transverse opening of the casing to said second side thereof for engagement with lock operating means to be controlled by said lock mechanism, biasing means joining said first and second disk members for biasing the second disk member to rotatably follow the rotation of said first disk member upon manual rotation by said handle portion, said second disk member having a projection extending radially outward therefrom, plunger means carried by said casing and resiliently urged radially inward toward the common axis at a first location around the casing spaced from said inlet opening, said plunger means having a coin-engaging portion disposed in a first plane normal to the axis of said first disk member, said plunger means being positioned to be displaceable radially outwardly by a coin carried in the recess of the first disk member upon rotation thereof, said plunger means being located when the positioned radially inward to engage to said projection of the second disk member for blocking rotation thereof and when displaced radially outwardly to clear said projection of said second disk member and for permitting rotation thereof, said detent means carried by the casing and engaging the second disk member to permit rotation of the second disk member in one direction only relative to said casing, the improvement of the first disk member having a recess therein for accommodating sid two abutting coins to position at least one of said coins in a plane normal to the axis of said first disk member and the said plane of said coin-engaging portion of the plunger means to engage and press against the plunger means, said at least one coin being maintained by the other of said abutting coins in position to engage in said plane the coin-engaging portion of the plunger means and to press against the same to move the plunger means outwardly upon rotation of the disk member, said movement of said first disk member to cause the coins carried thereby to engage and move said plunger means outwardly also, through said biasing means, moving said second disk member and projection carried thereby to clear said plunger means.

5. The improvement claimed in claim 4 and in which said recess accommodates and maintains said two coins in abutting face-to-face relationship in said plane whereby one of said coins is maintained flat in said plane to engage said coin-engaging portion of the plunger means by the other of said coins abutting the first coin.

6. The improvement claimed in claim 4 and in which said recess accommodates and maintains said two coins in edge-to-edge relationship in said plane whereby one of said coins engages the coin-engaging portion of the plunger means in said plane, and the other coin backs up the first coin to limit backward movement of the first coin upon its engagement with, and pressing against, the coin-engaging portion of the plunger means.

* * * * *